United States Patent [19]

Bhate

[11] Patent Number: 4,627,251

[45] Date of Patent: Dec. 9, 1986

[54] COMBINED MECHANICAL AND MAGNETIC LOCKING SYSTEM

[76] Inventor: Suresh K. Bhate, 1154 Mohawk St., Schenectady, N.Y. 12309

[21] Appl. No.: 651,171

[22] Filed: Sep. 17, 1984

[51] Int. Cl.[4] ..... E05B 27/06; E05B 47/00

[52] U.S. Cl. ..... 70/276; 70/364 A; 70/419

[58] Field of Search ..... 70/276, 358, 364 A, 70/416, 419, 421

[56] References Cited

U.S. PATENT DOCUMENTS

| | | | |
|---|---|---|---|
| 3,416,336 | 12/1968 | Felson | 70/276 |
| 3,512,382 | 5/1970 | Check | 70/276 |
| 3,837,194 | 9/1974 | Fish | 70/276 |

*Primary Examiner*—Robert L. Wolfe

*Attorney, Agent, or Firm*—Schmeiser, Morelle & Watts

[57] ABSTRACT

In a locking system, a combination of mechanical tumblers which are moved into a release position by the shape of the key and at least one magnetic tumbler which is drawn into the release position by a visually nondiscernible magnet placed on the key. The lock style being standard in that it includes inner and outer cylinders wherein the inner cylinder rotates between an open and locked position. In an alternate embodiment of the subject invention, an additional tumbler made from a magnetically attractible material is placed in the cylinders and biased to the open position. Should the key being used to open the lock contain a magnet substantially adjacent to this additional magnetic tumbler, the tumbler will be drawn to the locked position thereby preventing the rotation and opening of the inner cylinder.

2 Claims, 5 Drawing Figures

COMBINED MECHANICAL AND MAGNETIC LOCKING SYSTEM

FIELD OF THE INVENTION

This invention relates to locks and more specifically to locks which utilize magnets in their operation.

BACKGROUND AND SUMMARY OF THE INVENTION

Locks have been developed to meet a wide variety of needs. The most common type of lock use inner and outer cylinders with tumblers which, when moved to the correct position, allow the inner cylinder to rotate within the outer cylinder. The type of key utilized in such a lock is cut so that when the key is placed within the lock the tumblers are moved to their release position thereby enabling the key to rotate the inner cylinder. This type of locking and release mechanism may be referred to as a mechanical lock since the tumblers are physically moved by the shape of the key.

While the mechanical lock is the most common used in today's society it has several distinct disadvantages. First, anyone gaining access to another's key can have it copied within a matter of minutes at any local locksmith or other store having such a service. This is an even more severe problem with motels and businesses wherein a prior patron or ex-employee can have a key copied so as to enable him to enter at some later time. A second disadvantage of the standard mechanical lock is the ability of individuals, with little training or expertise, to learn how to pick these locks with little or no difficulty. Picking tools and instructions are available from most locksmith supply shops, and in most the purchaser need not even identify himself.

In an attempt to overcome these difficulties many types of magnetic locks were developed. These locks would use magnets as tumblers and also place magnets instead of ridges and indents within the key. Thus, one seeking to copy the key would first have to test it in order to determine the positions of the various magnets before a duplicate could be constructed. Alternately, in order to pick the lock one would have to utilize a device for detecting the presence and positions of the magnet tumblers. While such devices clearly aided in preventing unwanted individuals from entering the premises or other secured area several shortcomings were also encountered.

From a practical point of view, probably the most serious shortcoming or magnetic locks was the fact the keys which were used clearly stood out as being different since they did not utilize standard mechanical locking means. Thus, one obtaining such a key would clearly notice that there was a different locking mechanism and would either go to the additional difficulty of creating a duplicate by detecting where the magnets were placed or else would simply seek other access to the premises or other secured area. In addition, since the tumblers themselves were actually magnets an individual seeing the key or being suspicious that the lock was in someway different could easily test for the magnets and with little difficulty develop the correct combination of magnets in a key-like structure to open the lock.

It was with an awareness of these difficulties that I began the development which eventually led to the subject invention. One of the concepts which led to the development of one of the features of this invention involved the dual use of magnetic tumblers to both lock and unlock the inner cylinder. Other features, which will be explained hereafter, were developed primarily in an attempt to produce a lock which could resist most if not all attempts at picking yet were simple enough to be made easily available for virtually all individuals.

It was therefore a main purpose of this invention to provide a locking mechanism which utilized two types of release means, one mechanical and one magnetic.

Another object of this invention was to provide a locking system which appeared like a standard mechanical lock yet included visually undetectable magnetic locking features.

Another object of this invention was to provide a lock which utilized magnetic means which could not be readily detected.

Another object of this invention was to provide a locking system wherein the nonspecific application of magnets to the system would serve to both unlock and lock the inner cylinder.

It was a further object of this invention to provide a locking system which while being highly effective and secure was also inexpensive to manufacture.

Other objects and purposes of the subject invention may become evident from the remainder of this disclosure.

Briefly described, the subject invention discloses a mechanical locking system which utilizes inner and outer cylinders wherein the inner cylinder rotates between a locked and opened position. Tumblers within the cylinders prevent the inner cylinder from turning until the key which is inserted therein moves the tumblers to their predetermined positions, as dictated by the configuration of the key, thereby releasing inner cylinder for rotation and unlocking. In addition, another tumbler is made out of a material which is magnetically attracted but in itself is not a magnet. This tumbler coincides with a visually undiscernable magnet which is placed in the mechanical type key. Full insertion of the key into the lock causes the magnet to be aligned adjacent with the tumbler such that the magnet draws the tumbler to its open position.

Also briefly described, the subject invention has the above described embodiment and includes an additional tumbler which is also made of a material which is attracted to a magnet. However, this second tumbler is biased to an unlocked position and, when the key is fully inserted into the lock, is aligned adjacent to a portion of the key which does not contain a magnet. Thus, insertion of a key which is fully magnetized would draw the second tumbler from its biased unlocked position to a locked position thereby preventing rotation of the inner cylinder.

DETAILED DESCRIPTION OF THE DRAWINGS

Figure 1:
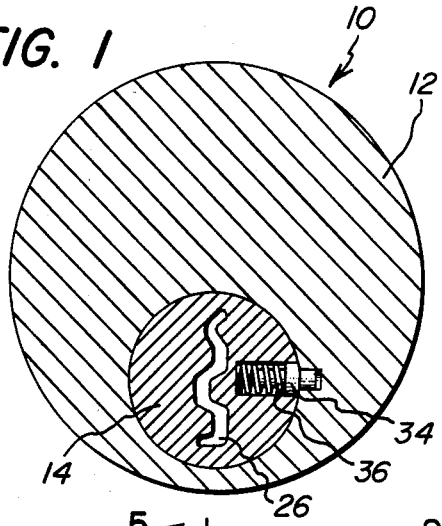
FIG. 1 is a cross sectional view of the lock taken along identical lines as FIG. 2 but showing the magnetic tumbler position with the key removed.
Figure 3:
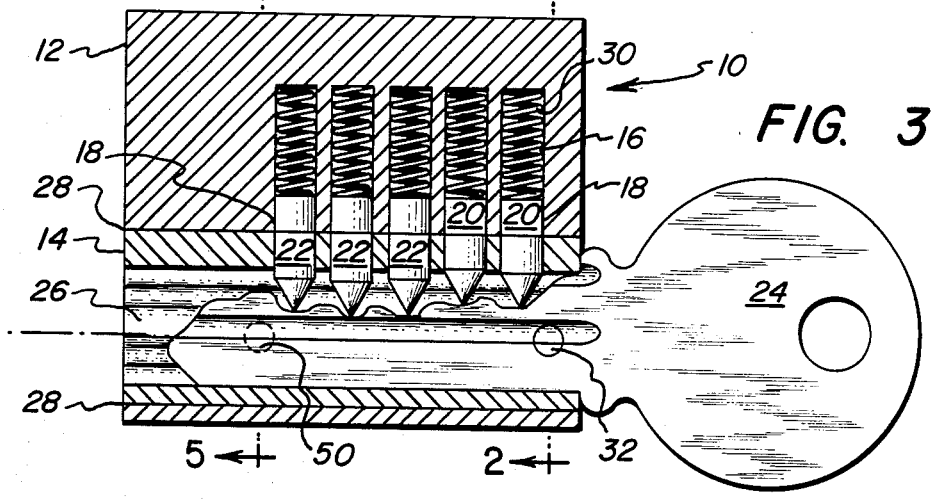
FIG. 3 is a cross sectional view taken along lines 3—3 of FIG. 2.

FIG. 1 is a cross sectional view of the lock generally designated as 10. This lock 10 has an outer cylinder 12 and an inner cylinder 14. When unobstructed the inner cylinder 14 rotates within the outer cylinder 12 and thereby wuthdraws a bolt or other means well known in the art and therefore not disclosed in this subject invention. As shown in FIG. 3 the inner cylinder is in its locked position but upon rotation would move to the open position.

A number of channels 16 transverse the inner and outer cylinder and said channels are aligned when the inner cylinder is in its lock position. Within each channel 16 is a tumbler 18. Each tumbler 18 is divided into two separate parts, a top portion 20 and a bottom portion 22. When the key 24 is inserted into the keyhole 26 the tumblers 18 are raised in accordance with the configuration of the key such that when the correct key is inserted the line between the top and bottom portions of the tumbler correspond with the separation, as shown at 28 between the inner and outer cylinders. Thus, when the key is inserted the tumblers are in their release position which allows the inner cylinder to be rotated to its open position.

Each of the tumblers 18 is biased toward the keyhole 26 by spring member 30 which is also placed within channel 16. Removal of the key 24 allows the springs 30 to advance the tumblers to their lock position wherein the top portion 20 transverses the separation 28 and thereby prevents a rotation of the inner cylinder.

The area of key 24 which is indicated by the circle 32 is magnetized. In my preferred embodiment this is accomplished by inserting a magnet in the area indicated in such a manner that the presence of the magnet is not visually discernable.

As shown in FIG. 1 the first magnetic tumbler 34 which is made of a material that is attracted by the magnet but will not under the subject conditions serve as a magnet itself. The tumbler 34 is a unitary structure which is biased by a spring 36 to the lock position wherein the first magnetic tumbler transverses the separation 28 between the inner and outer cylinders.

Figure 2:
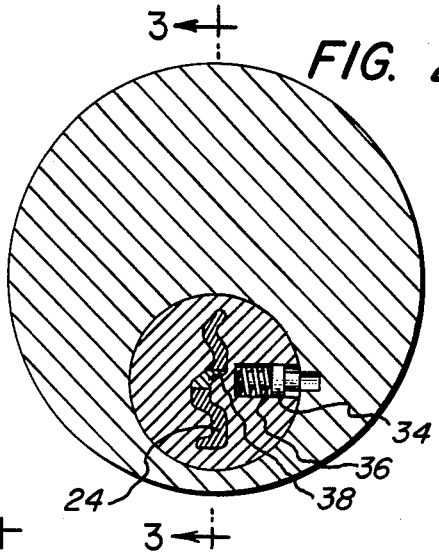
FIG. 2 is a cross sectional view of the entire lock taken along the lines 2—2 of FIG. 3.

FIG. 2 shows the position of the first magnetic tumbler 34 when the key 24 is fully inserted. As shown in this figure the magnet 38 which is positioned in the area designated by circle 32 is aligned adjacent to the first magnetic tumbler. The attraction between the magnet and the first magnetic tumbler draws the tumbler 34 totally within the inner cylinder 14 so that said cylinder may be rotated to the open position.

Figure 4:
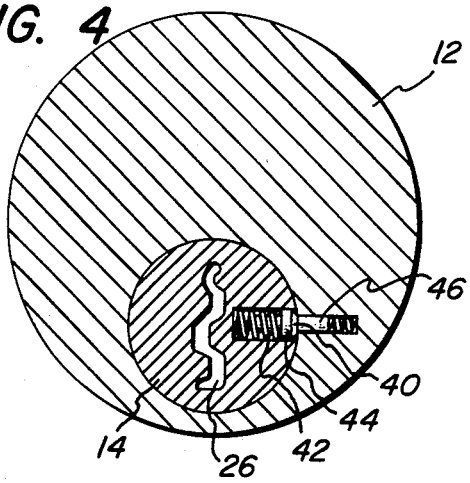
FIG. 4 is a cross sectional view taken along the same cross section as FIG. 5 but showing the second magnetic tumbler without the key inserted.

FIG. 4 shows the second magnetic tumbler 40 which like the first tumbler is of a material which is attracted to a magnet but which itself would not become magnetized under the subject use. This second magnetic tumbler 40 has biasing springs 42 which maintain the tumbler in its release position. This tumbler 40 has two portions, a base portion 44 and a stud portion 46. In its normal biased position the separation between the stud portion 46 and the base portion 44 coincide with the separation 28 between the inner and outer cylinders thereby allowing the inner cylinder to rotate to its open position.

Figure 5:
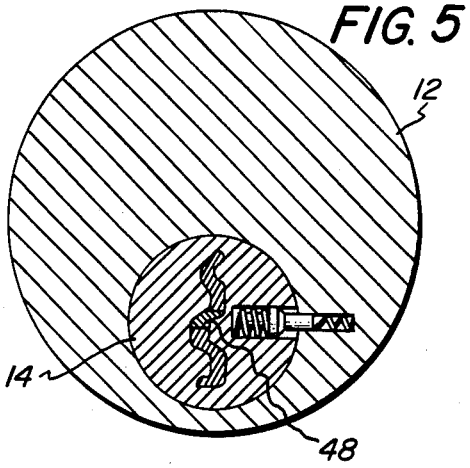
FIG. 5 is a cross sectional view of the entire lock taken along lines indicated by 5—5 of FIG. 3.

As shown in FIG. 5 when a magnet such as that indicated at 48 is aligned adjacent to the second magnetic tumbler 40 the stud portion 46 is drawn toward the magnet thereby traversing the separation between the inner and outer cylinders and preventing rotation of the inner cylinder. The magnetic area indicated at 48 corresponds to the circle drawn in phantom at 50 in FIG. 3. Thus, should one make a copy of the individual's key and use a key which is totally magnetized although the first magnetic tumbler 34 would be released the second magnetic tumbler 44 would move to its lock position thereby preventing the opening of the lock.

In operation, the key 24 is inserted into the keyhole 26 of the lock 10. The configuration of the key 24 moves the tumblers 18 to a release position wherein the inner cylinder 14 of the lock 10 can be rotated within the outer cylinder 12. A magnetized area on the key 24 corresponds with a first magnetic tumbler 34 and draws that tumbler from a biased lock position to a release position for the rotation of the inner cylinder. A second magnetic tumbler 40 is biased to the open position and will remain in that position unless the portion of the key which is adjacent to tumbler 40 is magnetized in which case tumbler 40 is drawn to a lock position.

While the above disclosure describes the preferred embodiment of this invention the scope of this application is intended to be limited only by the appended claims.

I claim:

1. A lock mechanism comprising:

an outer cylinder;

an inner cylinder rotatably mounted within said outer cylinder for movement between a lock and open position, said inner cylinder having a keyhole therein;

a set of mechanical tumblers moveable between a lock position wherein each tumbler blocks the space between the cylinders thereby preventing rotation of the inner cylinder, and a release position where in each mechanical tumber does not block the space between the cylinders and thereby allows the inner cylinder to rotate;

at least one magnetically attractable tumbler, which is not a magnet, also moveable between a lock position wherein the separation between the inner and outer cylinders is traversed and the inner cylinder is prevented from rotating, and an open position wherein the space between the inner and outer cylinders is not traversed and the inner cylinder can rotate to its open position, said magnetically attractable tumbler being spring-biased to the lock position; and a second tumber having a base and a separate stud portion, said tumbler being made of material which is not a magnet but is magnetically attractable, and positioned within the cylinders for movement between a release position wherein the space between the cylinders coincides with the space between the base and the stud, and a lock position wherein the stud traverses the space between the cylinders, said base being spring-biased to the open position and another spring biasing the stud to the base and pressing the stud toward the lockd position, such that when attracted by a magnet placed within the keyhole at a position adjacent to said second magnetic tumbler, the magnetic force, when sufficient, compresses the base biasing spring and said stud spring moves the stud to the lock position traversing the space between the cylinders.

2. The invention of claim 1 in combination with a key adapted to fit within the keyhole, said key being of such shape to move the mechanical tumblers to the release position and said key having a visually nondiscernable magnet within it, said magnet position to align adjacently with the magnetic tumbler when the key is inserted into the keyhole.

* * * * *